United States Patent [19]

Mathias

[11] Patent Number: 4,686,916

[45] Date of Patent: Aug. 18, 1987

[54] TRANSPORT AND GUIDE FOR SEWING LIMP FABRIC

[75] Inventor: Anthony D. Mathias, Toorak, Australia

[73] Assignee: Dunlop Olympic Limited, Victoria, Australia

[21] Appl. No.: 852,450

[22] PCT Filed: Jul. 25, 1985

[86] PCT No.: PCT/AU85/00175

§ 371 Date: Mar. 25, 1986

§ 102(e) Date: Mar. 25, 1986

[87] PCT Pub. No.: WO86/00944

PCT Pub. Date: Feb. 13, 1986

[30] Foreign Application Priority Data

Jul. 26, 1984 [AU] Australia ..... PG6238

[51] Int. Cl.[4] ..... D05B 21/00

[52] U.S. Cl. ..... 112/121.12; 112/308; 112/262.1; 112/102

[58] Field of Search ..... 112/308, 309, 121.12, 112/121.11, 102, 121.15

[56] References Cited

U.S. PATENT DOCUMENTS

| | | | |
|---|---|---|---|
| 3,358,626 | 12/1967 | Bryan | 112/308 X |
| 3,448,705 | 6/1969 | Scherr et al. | 112/102 |
| 3,741,140 | 6/1973 | Mencaldi | 112/102 |
| 3,970,017 | 7/1976 | Babson et al. | 112/309 X |
| 4,019,448 | 4/1977 | Blessing et al. | 112/308 X |
| 4,498,404 | 2/1985 | Sadeh | 112/121.12 |
| 4,553,489 | 11/1985 | Landwehr | 112/309 X |

*Primary Examiner*—H. Hampton Hunter

*Attorney, Agent, or Firm*—Fred Philpitt

[57] ABSTRACT

A method of sewing along a marginal edge of a fabric piece wherein the fabric piece in a flat state is gripped between a stationary low friction surface and a movable high friction surface, so that movement of the high friction surface relative to the low friction surface will slide the fabric piece over the low friction surface, while maintained in the flat state. The fabric piece is gripped so that the marginal portion to be sewn is exposed, and as the fabric piece is moved over the low friction surface the marginal portion of the fabric piece is moved along a path through a sewing machine head so a sewing operation may be performed thereon.

13 Claims, 7 Drawing Figures

TRANSPORT AND GUIDE FOR SEWING LIMP FABRIC

This invention relates to the handling of limp fabric in manufacturing processes and in particular to the handling of such fabric while performing sewing operations thereon.

The fabrication of garments from fabric is currently a labour intensive process, principally because of lack of mechanical means for feeding fabric through a sewing machine, particularly when the sewing operation is not along a linear path.

It is the principal object of the present invention to provide a method and apparatus to effectively transport pieces of fabric through one or more work stations wherein operations may be carried out on the fabric piece at required locations.

There is thus provided by the present invention a method of sewing along a marginal edge of a fabric piece comprising gripping the fabric piece in a flat state so said marginal part is exposed, moving the fabric piece while so gripped to pass said marginal part through a sewing machine head, and maintaining said marginal part flat during said movement.

Conveniently the fabric piece is gripped between a stationary low friction surface and a movable high friction surface, so that movement of the high friction surface relative to the low friction surface will slide the fabric piece over the low friction surface, while maintained in the flat state. The fabric piece may be engaged by the high friction surface over a substantial portion of the area thereof, or at a plurality at selected locations. The locations are selected so that during movement of the high friction surface at least said marginal part of the fabric piece is maintained flat as it is passed through a sewing machine head.

The marginal part of the fabric piece may move along a linear path through the sewing machine head, whereby a straight row of stitching is applied to the marginal part, or along any desired path contoured in the plane of movement of the fabric piece.

There is also provided by the present invention apparatus for use with a sewing machine for guiding a fabric piece while being sewn along a marginal part comprising a substantially flat surface to be located about a sewing machine head substantially co-planar with the sewing plane of the sewing machine head, a transport member adapted to grip a fabric piece located in a flat state on said surface, means to move said transport member relative to said flat surface to slide the fabric piece therealong while the fabric piece is maintained in said flat state, and means to guide said movement of the transport member so a marginal part of the fabric piece will pass through the sewing machine head.

Conveniently the flat surface is of a low friction character, and the transport member has a high friction surface or surfaces to frictional grip the fabric piece so that it is maintained in the flat state as it is slid along the low friction flat surface.

Preferably the transport member has a track thereon, of a shape determined by the required path of the fabric piece through the machine head. Drive means are provided to co-operate with said track to effect the movement of the fabric piece through the machine head. The drive means operate so the movement of the fabric piece is co-ordinated with the sewing speed of the machine head.

Preferably the transport member is a plate like member having one face coated with a high friction material. The plate member is positioned on top of the fabric piece with the friction material in contact with the fabric piece, which in turn is supported in a flat state on the low friction surface. The weight of the transport member, and the nature of the friction material is such as to establish sufficient friction grip of the fabric piece that as the transport member is slid over the low friction surface the fabric piece is carried therewith maintained in the flat state.

The peripheral contour of the plate, and its disposition on the fabric piece are arranged so a marginal part of the fabric piece extends beyond a peripheral edge of the transport member, whereby a sewing operation may be performed on that marginal part when passed through the sewing machine head. Conveniently the track is located adjacent the peripheral edge of the plate from which the marginal part of the fabric piece projects. The track is shaped to correspond to the required path of the marginal part of the fabric as it passes through the sewing machine head.

There may be more than one track on the transport member, with respective marginal parts of the fabric piece projecting from the peripheral edge of the transport member associated with each track. Thus each track may in turn be brought into co-operation with the drive means to effect several independent sewing operations on respective portions of the fabric piece.

The invention will be more readily understood from the following description of one practical arrangement of the method and apparatus for transporting fabric pieces as illustrated in the accompanying drawings.

In the accompanying drawings:

FIG. 1 is a perspective view from above the transport member as used in the present invention.

FIG. 1*a* is diagrammatic representation of a fabric blank of a ladies brief positioned on the transport member.

Figure 1:
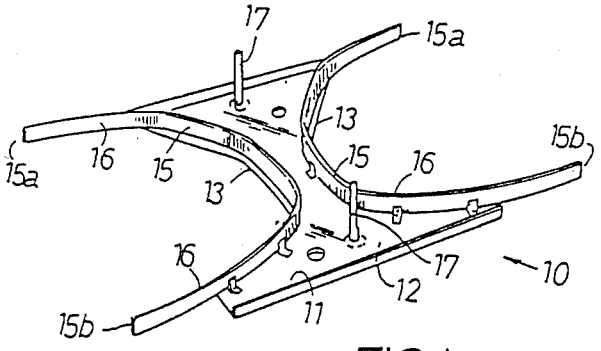
Figure 1A:
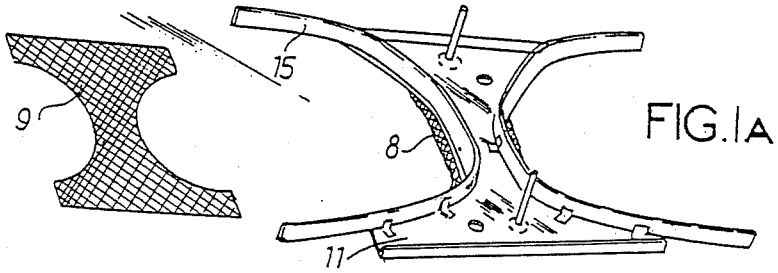

Referring firstly to FIG. 1 which is a perspective view of a transport member 10 comprising a generally flat plate 11 having an undersurface 12 covered with a high friction material coating. This particular transport member is designed for transporting the fabric blank 9 (FIG. 1*a*) used in the manufacture of briefs, particularly women's briefs. Accordingly the plate is of a generally hour-glass type shape corresponding to the shape of the fabric blank 9 for the brief.

The opposite curved edges 13 of the plate 11 are of a shape corresponding to the marginal portion 8 of the blank which will form leg opening in the finished brief. The following description will be in relation to the use of the transport member to carry the fabric piece through sewing machine heads to apply an elasticized band to the two marginal portions 8 of the fabric blank, which will form the leg opening in the finished garment. The proportions of the plate are such that a marginal portion 8 of the fabric piece will project beyond each of the two curved edges 13, and will so be exposed to permit the applying of the elasticized band to that part of the fabric blank 9 as seen in FIG. 1.

Upstanding from the upper surface of the plate 11, opposite to that to which the friction coating is applied, are two track members 15 which following the contour of the respective curved edges 13 of the plate 11 and having extensions 15*a*, 15*b* at either end projecting beyond the extent of the plate 11. The inwardly directed surfaces 16 of the tracks 15 also have a layer of high friction material applied thereto for reason which will be subsequently described.

Also upstanding from the upper surface of the plate 11 are two spaced pins 17, which are used in the transportation and orientation of the transport member 10 to deliver it to a sewing head as hereinafter described.

Figure 2:
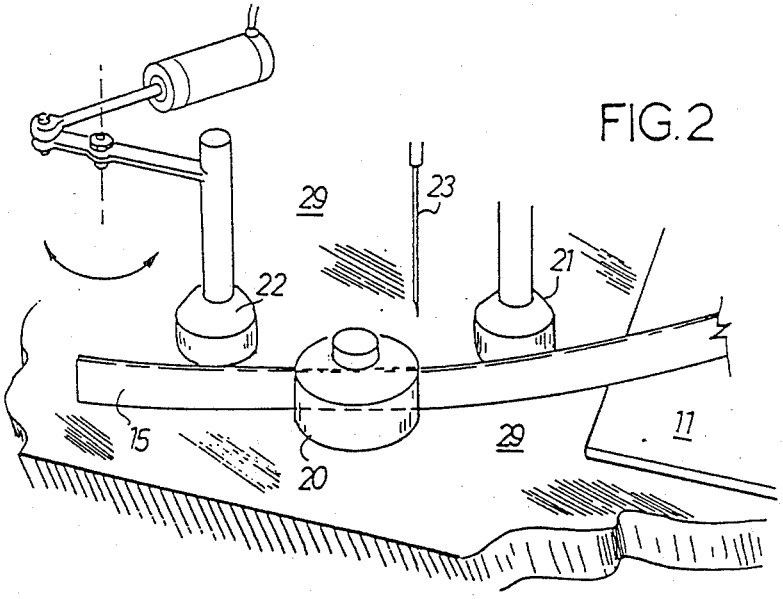
FIG. 2 is a schematic representation of the driven mechanism to feed the transport member through a sewing machine head.

Associated with each sewing machine head are a series of three rollers 20, 21 and 22 as depicted diagrammatically in FIG. 2. Each of the rollers are mounted for rotation on respective axis parallel to the line of reciprocation of the sewing head needle 23. The rollers 21 and 22 being free rolling and the roller 20 driven by a suitable motor. The free rotating roller 22 is mounted on an arm 24 which is pivotally supported on a component stationary relative to the sewing head, the arm also being coupled to an actuating cylinder 25.

Figure 4:
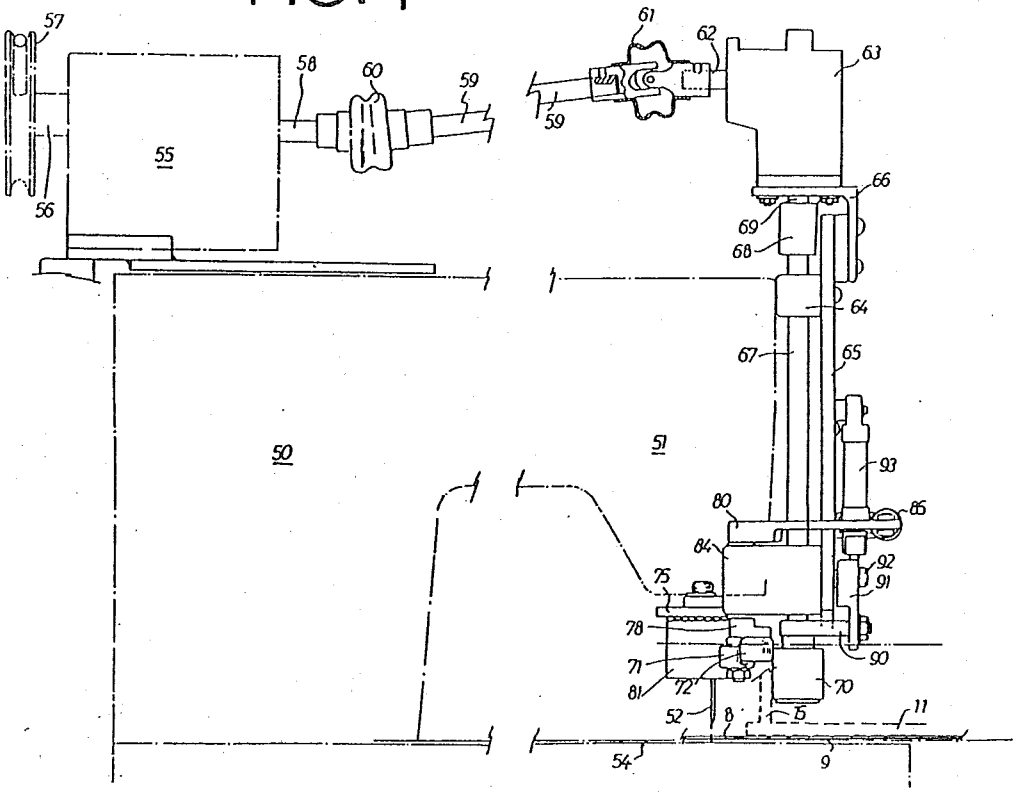
FIG. 4 is a side elevation of a conventional sewing machine incorporating the additional mechanism for operating in the performance of the present invention.

The rollers are each supported from above so that the plate 11 may pass freely beneath the rollers, with one of the tracks 15 passing between the rollers so that the rollers 21 and 22 will hold the track 15 in pressure engagement with the driving roller 20. In this position the drive roller 20, which also has a friction coating on the peripheral surface thereof, engages the friction surface 16 on the track 15, and hence rotation of the roller 20 will feed the track 15 through the roller assembly, and accordingly carry the plate 11 beneath the sewing machine head. As can be seen in FIG. 4 when one of the tracks 15 is in the operative position with respect to the rollers 20, 21 and 22, the marginal portion 8 of the fabric, projecting beyond the curved edge 13 of the plate 11, is located below the sewing needle 23. Hence as the roller 20 feeds the track 15 forward the marginal portion 8 of the fabric passes beneath the sewing needle and the sewing operation may be performed thereon in the normal manner.

The sewing head of the machine has associated therewith an extended flat surface 29 covering a substantial area about the needle and feed mechanism of the sewing machine, and being sufficient in extent to support the fabric piece as it is fed to, through, and from the assembly of rollers 20, 21 and 22. This surface 29 is substantially flat and has an upwardly directed face with a low friction characteristic, such as is obtained with various known laminate surfaces such as those marketed under the trade marks LAMINEX and FORMICA.

The weight of plate 11 and the tracks 15 carried thereby, and the frictional characteristics of the friction coating on the under surface are such that, when the plate 11 is located on a fabric blank 9, lying in a flat state on the surface 29, movement of the plate 11 over the surface 29 will cause the fabric piece to be carried with the plate, and will be maintained in its flat state as it slides over the surface 29.

Conveniently means may be provided to apply additional downward pressure on the plate as the track member is being fed through the roller assembly, to ensure that there is no tendency for the plate to lift under the action of the drive roller. In this regard an arm may be provided and arranged to be raised and lowered into and out of engagement with the track 15 on the plate 11. The arm is lowered into engagement with the track, when it initially enters between the rollers, and is raised after the track has left the roller assembly in readiness for the entry of the track of the next plate 11.

It will be appreciated from the previous description that, as the track 15 extends over an arc of approximately 180°, as the plate 11 passes through one sewing machine head the movement imparted thereto, by the co-operation of the track 15 with the roller assembly, will result in the plate being rotated through approximately 180°. This will locate the plate 11 in a position for subsequent transfer to a second sewing head having a similar second roller assembly as previously described.

This second roller assembly will then co-operate with the other track 15 on the plate 11, and pass the fabric blank through another machine head in a manner so that the elasticized band is applied to the opposite leg opening defining edge of the fabric blank.

Suitable conveyor or other motion inducing means are provided to co-operate with the transport member 10 such as by engagement with the pins 17 to affect the necessary movement of the transport member to bring the respective tracks 15 into co-operation with the respective roller assemblies 20. A number of such conveyors may be provided where more than one operation is to be carried out on the same fabric blank while in gripping relationship to the transport member.

Figure 3:
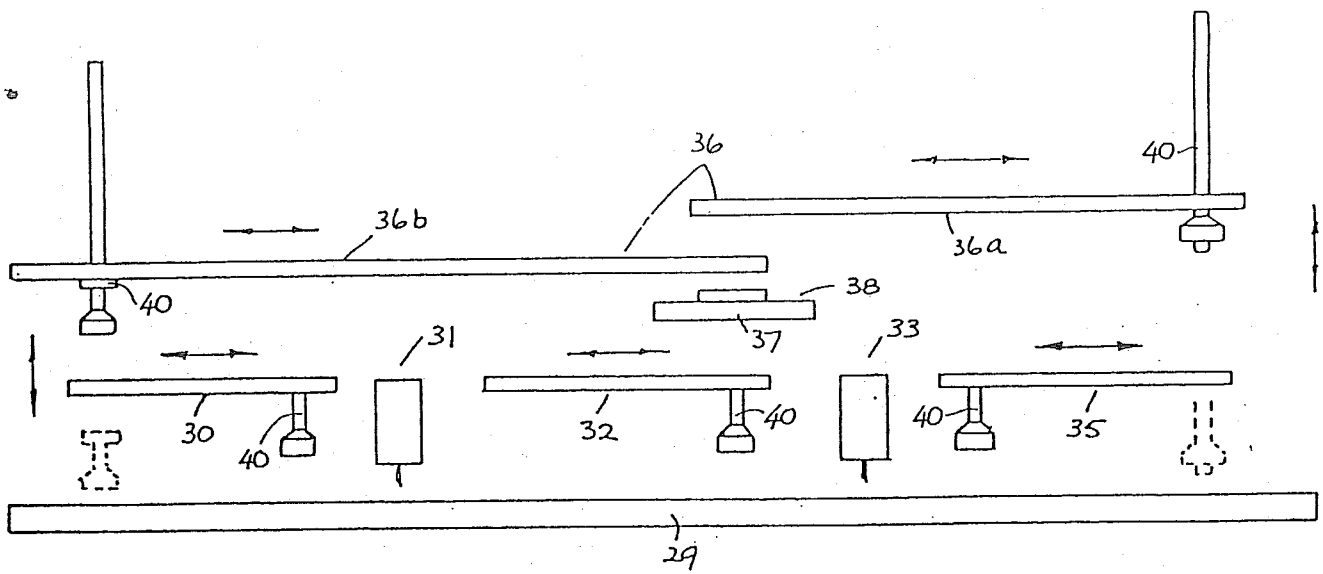
FIG. 3 is a schematic representation of the conveyor system that may be used in conjunction with the transport member in performing two sewing operations on the fabric blank.

Referring to FIG. 3 the first conveyor 30 is provided to deliver the transport member 10 to a first sewing machine head 31, a second conveyor 32 to co-operate with the transport member after delivery from the first sewing machine head 31 and to deliver it to a second sewing machine head 33 to carry out a further operation on another section of the fabric piece. A third conveyor 35 is provided to carry the transport member 10 from the second machine to a location where the fabric is separated from the friction surface of the transport member.

Each of the conveyors include two dependent rods as illustrated diagrammatically at 40 in FIG. 3 which co-operate with the pins 17 on the transport member 10. The rods may carry a collet at the lower end to receive and grip the pin.

The rods are to be mounted for up and down movement with respect to the transport member, such as by suitable pneumatic cylinders. The rods 40 are lowered to engage the pins 17 and remain lowered while the conveyor moves forward sliding the transport member and the fabric blank thereunder over the support surface. Upon the transport member reaching the required location the collets release the pins, and the rods are raised clear of the transport member.

The return conveyor system 36 is provided to take the transport member from the point of separation from the fabric piece and deliver it back to the point where it may be brought into assembly with a further fabric piece to repeat the sequence of operation. The various conveyors which operate on the transport member may be controlled by suitable sensors responsive to the position of the transport member.

In the conveyor system 36 which returns the transport member to receive a further fabric piece, it is preferable to provide a transfer station 37 where the transport member 10 is passed from one conveyor 36*a* onto a stationary support 38 and subsequently collected from that support by a second conveyor 36*b*. This arrangement has the advantage that the depositing of the fabric piece after passing through the machine heads, and the picking up of the next fabric piece are not required to be in a strict timed relation, since the transport member may be left in the transfer location for a considerable time before passing to be deposited on the next fabric piece.

Figure 5:
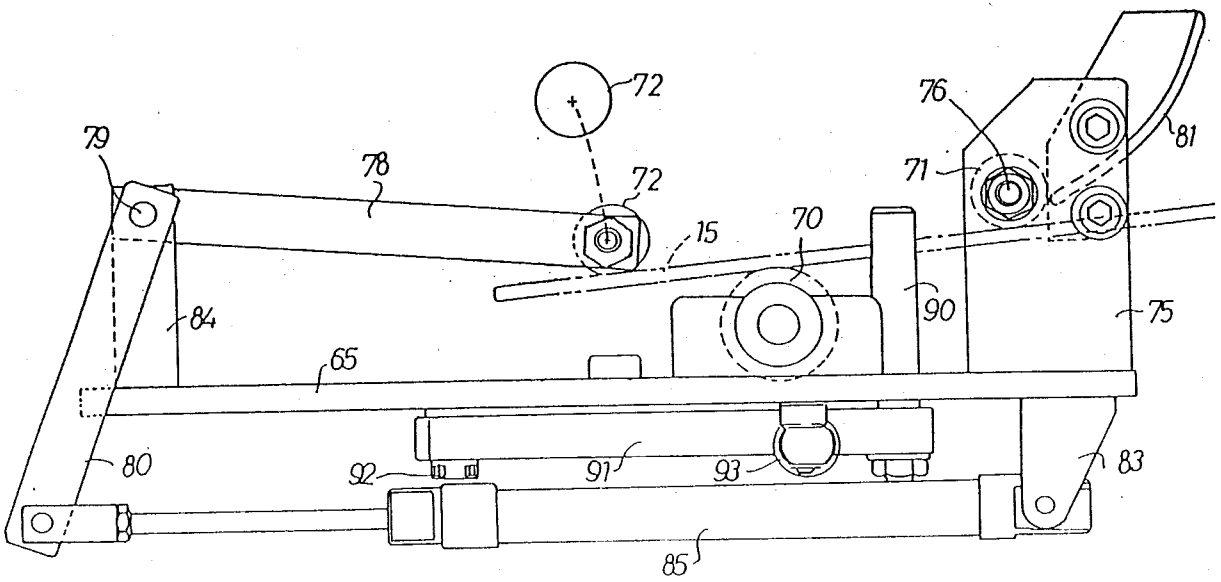
FIG. 5 is a view from above along line 5—5 in FIG. 4.
Figure 6:
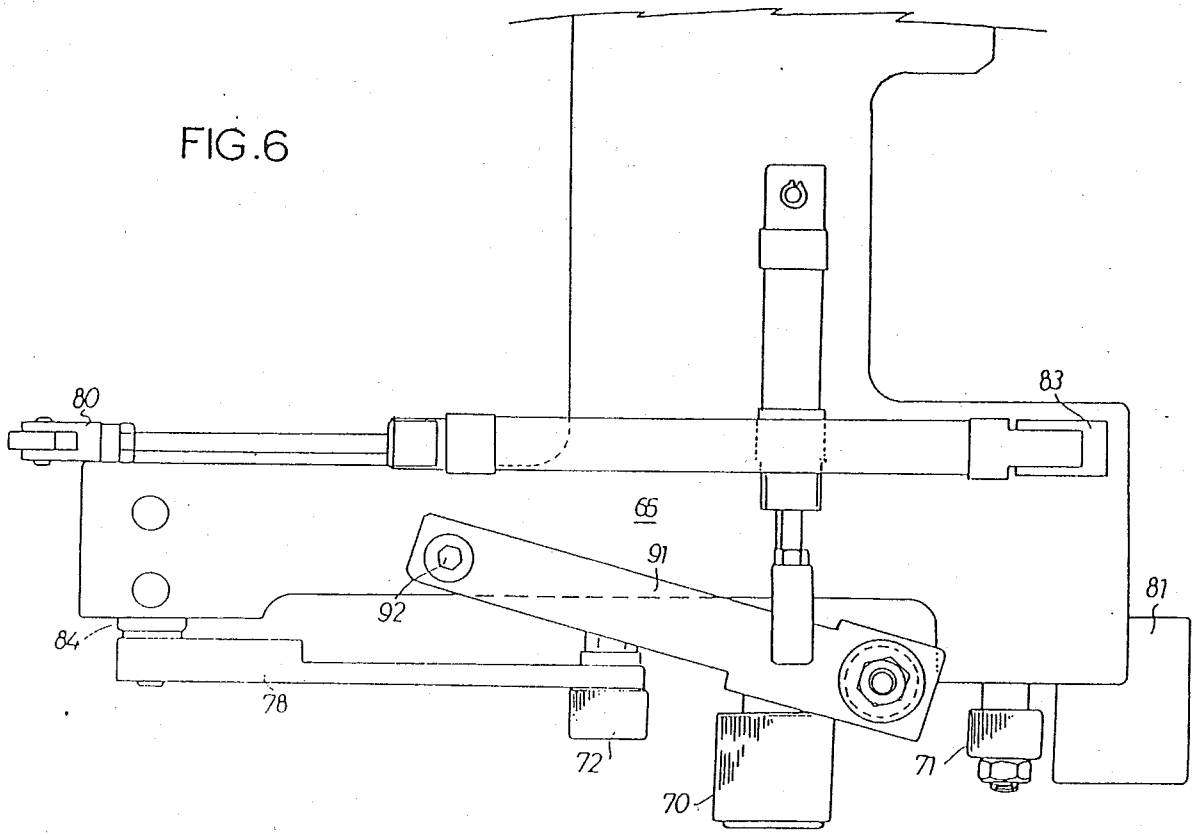
FIG. 6 is a side view of the part of the mechanism below line 5—5 in FIG. 4.

Referring now to FIGS. 4, 5 and 6 there is depicted in more detail the arrangement of the rollers that effect the movement of the transport means through the sewing machine. The mechanism shown is for fitment to a conventional type industrial sewing machine and is of a bolt-on construction so that with relatively minor modification may be rendered suitable for most sewing machines in industrial use.

The body of the sewing machine 50 is shown in broken outline, having an overhanging arm 51 from which a needle 52 projects to perform a sewing operation on a fabric piece passing therebeneath. The fabric piece is supported in a flat state on the bed 54 of the machine. The mechanism of the sewing machine 50 is unaltered from the conventional construction and accordingly no further description will be provided.

The speed reduction gear box 55 is mounted on the machine body 50 and has an input shaft 56 carrying the pulley 57 and an output shaft 58. The pulley is coupled by a belt to the drive mechanism of the conventional sewing machine, although if preferred a separate motor may be provided. The drive shaft 59, having universal joints 60 and 61 at each end, couples the output shaft 58 to the input shaft 62 of the right angle drive gear box 63.

The main mounting plate 65 is rigidly secured by bolts (not shown) to the body 50 of the sewing machine, and through the bracket 66 supports the gear box 63. The vertical shaft 67 is coupled at 68 to the output shaft 69 of the gear box 63 and carries at the lower end the drive roller 70. The shaft 67 is supported in bearing attached to the mounting plate 65, one bearing being shown at 64 in FIG. 4 and another at the lower end being hidden in the drawing.

The roller 70 corresponds to the drive roller 20 previously referred to in respect of FIG. 2, and has the external peripheral surface thereof covered or coated with a high friction material. The axis of the shaft 67 is parallel to the axis of reciprocation of the needle 52, and is laterally spaced therefrom a fixed distance. This distance is related to the distance of the track 15 spaced inwardly from the edge 13 of the plate 11 and the extent the marginal portion 8 of the fabric blank projects beyond the edge 13. The needle 52 must of course be clear of the edge 13 of the plate 11 and operate on the marginal portion of the fabric blank when the track 15 is in driving engagement with the roller 70. This relative relationship can be observed in FIG. 4.

As best seen in FIGS. 5 and 6, the fixed guide roller 71 (which corresponds to roller 21 in FIG. 2) is suspended from the bracket 75 projecting laterally from the mounting plate 65. The roller 71 is freely rotatable on the pin 76 by which it is attached to the bracket 75. The lateral displacement of the roller 71 from roller 70 as designated 'x' in FIG. 5 is sufficient to permit the entry therebetween from the right in FIG. 5 of the track 15 with suitable clearance to accommodate operational deviation of the track from an exact central position. To further assist in the entry of the track 15 between the roller 70 and 71, the guide 81 depends from the bracket 75 and presents a curved face 77 to the end of the track approaching the roller 71 to direct the track to enter between the rollers 70 and 71.

The roller 72, corresponding to roller 22 in FIG. 2 is suspended from the free end of the arm 78 which with the pin 79 and arm 80 form a bell crank. The pin 79 is rotatably supported in the bearing block 84 attached to the mounting plate 65. The arm 78 is attached to the lower end of the pin 79 and the arm 80 is attached to the upper end of the pin. The pneumatic cylinder 85 is connected between the other end of the arm 80 and the bracket 83 attached to the mounting plate 65. As can be seen in FIG. 5 the lateral displacement of the roller 72 from the roller 70 may be varied by operation of the pneumatic cylinder 85.

In operation as the end of the track 15 is being fed into the roller assembly 70, 71, 72, the cylinder 85 is retracted so that the roller 72 is displaced substantially from the roller 70 and shown in broken outline in FIG. 5. After the track 15 has entered the assembly so as to extend past the roller 72, the cylinder 85 is extended thereby bringing the roller 72 closer to roller 70 and into engagement with the track 15 as shown in full outline in FIG. 5.

This movement of the roller 72 will establish a pressure contact between the track 15 and the roller 70 sufficient to ensure that the rotation of the roller 70 will advance the track 15 through the roller assembly. Also, having regard to the varying contour of the track along its length, the compressible nature of the air in the cylinder 85 will allow lateral movement of the roller 72 to accommodate the changes in contour without loss of driving contact between the roller 70 and the track 15.

As it is necessary to provide clearance below the roller 70, for the plate 11 of the transport member 10 to freely pass therebelow, and as any lifting of the plate 11 may result in loss of contact of the fabric piece with the plate 11 or the surfaces it is sliding on, it is desirable to provide a holding down force on the plate 11. A tendency for the plate to lift up can arise from irregularities on the surface of one of the rollers on a slight incline of the axis of a roller.

In order to counteract such tendency, the horizontal roller 90 is provided, mounted on the arm 91 which is pivotally attached to the mounting plate 65 at 92. The pneumatic cylinder 93 is connected between the arm 91 and mounting 65 to effect controlled raising and lowering of the roller 90. The roller 90 extends transversely to the path of the track 15 through the roller assembly at a location between the roller 70 and 71. The cylinder 93 is retracted to raise the roller 90 as the track 15 enters the roller assembly 70, 71, 72, and is lowered to engage the top edge of the track as the roller 72 is moving the track in driving contact with the roller 70. Both rollers 72 and 90 are moved to their respective in-operative positions when the track 15 has completed its passage through the roller assembly.

Throughout the foregoing description reference has been made to the fabric piece being passed through the head of a sewing machine so that the sewing operation may be performed thereon. It is to be understood that the present invention is applicable to other forms of operation on the fabric piece and that the invention resides in the holding and transporting of the fabric piece in a flattened condition so that any required operation may be performed on part of the fabric piece, and that operation is not necessarily a sewing operation.

I claim:

1. An apparatus for guiding a limp fabric while a sewing operation is being performed thereon, comprising a substantially flat low friction surface to be located adjacent a sewing machine head substantially co-planar with the sewing plane of the sewing machine head upon which the fabric piece may be supported in a flat state, a transport member adapted to frictionally engage the exposed surface of the fabric piece at least along an area bordering said marginal portion so that at least part of the marginal portion is exposed, means to move said frictionally gripped area in a sliding movement along said surface, maintaining said part of the marginal portion flat, and means to guide said transport member along a path to move said part of the marginal portion through the sewing machine head, wherein the transport member includes a plate member having a flat surface with at least part of said surface of a high friction material or coating and track means secured to said plate member including a portion contoured to substantially correspond to the contour of the marginal portion to be sewn and the track means being located on the plate member so that the contoured portion is substantially parallel to the edge of the plate member from which the marginal portion projects, and wherein said moving means includes a roller assembly associated with said sewing machine head having at least one driving roller and arranged to cooperate with the track means to effect said sliding movement of the transport member along said path.

2. An apparatus as set forth in claim 1 wherein the high friction surface areas are disposed to frictionally grip the fabric piece in a plurality of areas bordering the exposed marginal portion extending in the direction of the length of said marginal portion.

3. An apparatus as set forth in claim 1 wherein the track means includes a lead-in portion and a guide-out portion at the respective ends of the contoured portion.

4. An apparatus as set forth in claim 1 wherein the roller assembly includes three rollers arranged to cooperate with the track means so that one roller engages one side of the track means and the other two rollers engage the opposite side of the track means at respective locations spaced on either side of the one roller.

5. An apparatus as set forth in claim 4 wherein the rollers are arranged to cooperate with the track means to guide the marginal portion of the fabric piece through the path of the sewing machine needle assembly so that the needle assembly operates on the marginal portion at a location adjacent said one roller.

6. An apparatus as set forth in claim 2 wherein the track means includes a lead-in portion and a guide-out portion at the respective ends of the contoured portion.

7. An apparatus as set forth in claim 2 wherein the roller assembly includes three rollers arranged to cooperate with the track means so that one roller engages one side of the track means and the other two rollers engage the opposite side of the track means at respective locations spaced on either side of the one roller.

8. An apparatus as set forth in claim 7 wherein the rollers are arranged to cooperate with the track means to guide the marginal portion of the fabric piece through the path of the sewing machine needle assembly so that the needle assembly operates on the marginal portion at a location adjacent said one roller.

9. An apparatus as set forth in claim 3 wherein the roller assembly includes three rollers arranged to cooperate with the track means so that one roller engages one side of the track means and the other two rollers engage the opposite side of the track means at respective locations spaced on either side of the one roller.

10. An apparatus as claimed in claim 9 wherein the rollers are arranged to cooperate with the track means to guide the marginal portion of the fabric piece through the path of the sewing machine needle assembly so that the needle assembly operates on the marginal portion at a location adjacent said one roller.

11. A method of performing a sewing operation on a marginal portion of a limp fabric piece, the edge of said marginal portion being of a non-linear contour, comprising supporting the fabric piece in a flat state on a low friction surface, frictionally gripping the exposed surface of the fabric piece at least along an area bordering said marginal portion so at least part of the marginal portion is exposed, moving said frictional gripped area of the fabric piece in a sliding movement along said low friction surface while maintaining the marginal portion flat, and during said movement passing said marginal portion through the sewing machine head along a complementary non-linear contour, characterized in that the exposed surface is frictionally gripped by a transport member which includes a plate member having a flat surface with at least part of said surface of a high friction material or coating, and track means secured to said plate member, and the frictional gripped area of the fabric piece is moved by means which includes a roller assembly associated with said sewing machine head having at least one driving roller and arranged to cooperate with the track means to effect said sliding movement of the transport member along said path.

12. A method as claimed in claim 11 where two marginal portions of the fabric piece are exposed and the fabric piece is gripped along areas bordering the respective exposed marginal portions, and each marginal portion is passed through a sewing machine head in sequence.

13. A method as claimed in claim 12 wherein said two marginal portions are located on opposite edges of the fabric piece and the fabric piece is rotated through approximately 180° between entering the first and entering the second sewing machine head, the fabric piece being maintained in said flat state on the low friction surface during said rotation.

* * * * *